US006311982B1

(12) United States Patent
Lebensfeld et al.

(10) Patent No.: US 6,311,982 B1
(45) Date of Patent: Nov. 6, 2001

(54) HIDE AND FIND TOY GAME

(75) Inventors: Steven Lebensfeld, Laurel Hollow; Simon Gouldstone, Bronx, both of NY (US)

(73) Assignee: Toymax Inc., Blainview, NY (US)

( * ) Notice: Subject to any disclaimer, the term of this patent is extended or adjusted under 35 U.S.C. 154(b) by 0 days.

(21) Appl. No.: 09/499,851

(22) Filed: Feb. 7, 2000

Related U.S. Application Data

(60) Provisional application No. 60/118,908, filed on Feb. 5, 1999.

(51) Int. Cl.[7] ..... A63H 5/00
(52) U.S. Cl. ..... 273/460; 773/454
(58) Field of Search ..... 253/454, 460; 340/323 R

(56) References Cited

U.S. PATENT DOCUMENTS

| | | | | |
|---|---|---|---|---|
| 3,443,338 | | 5/1969 | Collins . | |
| 4,496,149 | * | 1/1985 | Schwartzberg | 273/454 |
| 4,659,919 | | 4/1987 | Price . | |
| 4,793,052 | | 12/1988 | Ammann et al. . | |
| 4,961,575 | * | 10/1990 | Perry | 273/460 |
| 4,962,369 | | 10/1990 | Close . | |
| 4,973,052 | | 11/1990 | Conti . | |
| 5,072,213 | | 12/1991 | Close . | |
| 5,099,228 | | 3/1992 | Israel et al. . | |
| 5,204,657 | * | 4/1993 | Prosser et al. | 340/571 |
| 5,661,470 | | 8/1997 | Karr . | |

OTHER PUBLICATIONS

Patent Cooperation Treaty International Search Report, mailed Apr. 18, 2000, from the Unites States International Searching Authority, regarding International Application No. PCT/US00/02879, Attorney Docket No. 3910/187.

* cited by examiner

*Primary Examiner*—Raleigh W. Chiu
(74) *Attorney, Agent, or Firm*—Brown Raysman Millstein Felder & Steiner LLP

(57) ABSTRACT

A hide and find game includes a first game element to be hidden in a play area and a second, portable game element to be carried by a player through-out the play area. A wireless transmitter is incorporated in one of the first and second game elements to emit a signal of a given strength. A wireless receiver is incorporated in one of the first and second game elements to receive and compare the transmitted signal with a threshold level. The receiver includes a sound generator that is actuable to generate a sound informing the player that a second portable game element has been brought closer than a predetermined distance from the first hidden game piece whereby the player is prompted to find the first, hidden game element. The threshold level is set as a function of the predetermined distance.

9 Claims, 5 Drawing Sheets

HIDE AND FIND TOY GAME

CROSS-REFERENCE TO RELATED APPLICATION

This application claims priority to the U.S. provisional application Serial No. 60/118,908, filed Feb. 5, 1999.

BACKGROUND OF THE INVENTION

The invention disclosed herein relates to a hide and find game which includes at least one and preferably a plurality of elements to be hidden, known as game elements, and at least one finder or detector element, which is used by a game player to find the hidden element or elements. The game elements are hidden in a play area of finite boundaries typically by a player other than the one hiding the game elements. The game action promoted by this invention involves the hiding of one or more hidden elements and then using the detector element to locate the hidden elements.

The development of electronics, which can perform a variety of functions and can be manufactured at relatively low cost, has made the use of such electronics in toys attractive. In particular, toys which are capable of producing audible sounds upon activation by the user have in the past proven to be very successful. Noise-generating toys were activated by a user manually depressing a switch device. Further, this type of prior art had to be directly activated by the user thus limiting the play activity of the resulting toy.

Electronic circuits were adapted to electrically control the movement of toys and the audible sounds emitted therefrom. For example, U.S. Pat. No. 3,443,338 to Collins discloses a toy which simultaneously mimics a dog's physical movements while emitting an audible sound which imitates a dog's bark. The mechanism for eliciting the simulated dog movements and barks is directly activated by a switch controlled by the user.

U.S. Pat. No. 4,659,919 discloses a toy which avoids the use of a mechanical switch in a toy to initiate the generation of sound by incorporating an optical sensing circuit for activating an audio generator, which comprises optical sensors for sensing the intensity in at least one field of radiation. A comparator circuit is coupled to the optical sensors and triggers a pulse at a determined differential level in the intensity of light between the optical sensors. An oscillating circuit is reactively coupled to the comparator circuit and generates audio signals in response to the triggered pulse at the differential level determined by the comparator means. A speaker is coupled to the oscillator circuit for emitting the audio signals. The above described circuit is shown adapted for use in a toy doll which portrays a small child. The optical sensors are positioned in the eyes of the doll and the fields of radiation are the areas generally in front thereof.

U.S. Pat. No. 4,973,052 discloses the adaptation of electronics to the traditional children's game, RED LIGHT/GREEN LIGHT. The traditional game involves a number of players, a caller and the rest of the players who try to sneak up on the caller. The caller turns his or her back on the remaining players giving them a GREEN LIGHT to advance. At any time, the caller can turn around and yell RED LIGHT. If the caller sees any player moving, that player is sent back to the starting point. This patent replaces the caller with electronics, which include multiple indicators, sensors, timers, and switches to interact with one or more player(s). One such indicator includes a plurality of color coded lights usually one red and one green indicating stop and go respectively. Another indicator includes an audio output device indicating general player participation in addition to detecting motion with a sensor. A programmed microcomputer is coupled to the indicators, a motion sensor and a speaker. A randomly varying time interval is provided under program control. The toy functions to sense the motion of the player(s) and to initiate an output during the time when the stop or red indicator is lit. Motion detected during this time results in a specific audio output. When the green or go indicator is lit the audio output is altered.

Audio generators may be used in security systems to alert merchandisers of a detected theft. Each of U.S. Pat. Nos. 4,962,369; 5,072,213; and 5,099,228 describes such a security system and, further, the use of a wireless or RF transmission system which includes a transmitter that is coupled to the protected merchandise and is actuated to transmit a warning signal when an attempted theft is detected. A receiver is disposed remotely to detect the wireless signal and to provide an alarm, illustratively generated by an audio generator, warning of the theft. It is not necessary to dispose a transmitter at the site of the merchandise (or other object to be monitored). Other prior systems that detect or monitor dispose their transmitter proximate to the object to be monitored and transmit a wireless signal to a remote device which serves to actuate an alarm. The monitoring device can be passive and simply reflect energy back to the transmitter, which detects the reflected energy. Alternatively, the monitoring device may be active; such an active device may include its own receiver for receiving the transmitted signal, use that receive signal to energize its receiver and transmitter and, upon sensing a particular condition, actuate its transmitter to transmit a return signal to the remote transmitter, whereby a warning signal, e.g., an audio signal, may be generated at the remote transmitter.

Similarly, transmitters and receivers have been employed to find lost objects, such as keys or TV remote controls. Typically, a receiver is attached to the object which may be lost. The user, who is seeking to find the lost device, has a transmitter which transmits a wireless or RF signal. That signal is received by the receiver which in turn actuates a sound generator to aid the user in finding the lost object. Such transmitters and receivers are designed to operate over a relatively large area so that the lost object is found as quickly as possible. For example, if the TV remote control is lost in the family room of a home, the strength of the transmitted signal and sensitivity of the receiver are set so that all such receivers in that area of interest, e.g., the family room, will be activated to generate a sound.

OBJECTS AND SUMMARY OF THE INVENTION

Therefore, it is an object of this invention to adapt electronics to implement the play of a hide and seek game.

It is a still further object of this invention to enhance the play activity by actuating a sound that will prompt a player to find a hidden game element.

In another object of this invention, various sounds are generated not only to inform the player when he or she is relatively close to a hidden element, but also when the player is further than a predetermined distance.

In accordance with these and other objects of this invention, there is disclosed a hide and find game, which comprises a first game element to be hidden in a play area and a second, portable game element to be carried by a player throughout the play area. A wireless transmitter is incorporated in one of the first and second game elements to emit a signal of a given strength. A wireless receiver is incorporated in one of said first and second game elements to receive and compare the transmitted signal with a threshold level. The receiver includes a sound generator that is actuable to generate a sound informing the player that a second portable game element has been brought closer than a predetermined distance from the first hidden game element or is within the same room, or is on a line of sight with the first game element. The threshold level is set as a function of the predetermined distance.

In a further aspect of this invention, a visual indicator device may be used in lieu of or with the sound generator. The visual indicator may display messages relative to the location of the first hidden game piece or the distance between the first hidden game element and the second game element.

In a further aspect of this invention, the transmitter may transmit signals which when detected simply cause a sound tone to be generated, or they may be modulated or coded with information which when demodulated or decoded provide modulated or coded information at the receiver. For example, the wireless carrier may be AM or FM modulated with speech (e.g., "The hidden piece#1 is within range"), which is played by the portable game element.

In a further aspect of this invention, the information or signals indicative of the sound to be generated may be stored within a memory incorporated within the sound generator or otherwise connected thereto. The sound generator is operative in a first mode to generate a first sound indicative to the player that the portable detector is spaced a distance from the hidden game element not greater than the predetermined distance, thus alerting the player that the player is close to the game element hidden in the play area. The sound generator is also operable in a second mode to generate a second sound indicative to the player that the portable detector is spaced a distance from the hidden game element greater than the predetermined distance, thus alerting that the player needs to look further in the play area to find the hidden game element.

In a preferred embodiment of this invention, the wireless transmitter is incorporated into the first, hidden game element and the wireless receiver is incorporated into the second, portable game element.

In another aspect of this invention, both of the wireless transmitter and the wireless receiver are incorporated into the same one of the first, hidden game element and the second, portable game element. In the other of the first and second game elements, a device for reflecting the transmitted signal from the wireless transmitter signal is incorporated in the one game element to reflect back to the wireless receiver in the one game piece from the other game element.

In another aspect, the transmitters may transmit coded signals, which are decoded in the receiver, and the sound generator may provide responses dependent upon the particular code decoded by the receiver, for example, to identify the particular transmitter, to identify whether or not a particular transmitter is within or beyond a predetermined distance, and/or to provide encouraging messages to players to continue looking for hidden transmitters.

In a still further embodiment of this invention, a greater number of the hidden game elements may be included in the game than the number of portable detector elements. In one illustrative embodiment, the game may include only one portable detector element, while a plurality of the hidden game elements may be included. Inspection of FIGS. 2 and 3 indicates that the receiver includes more elements than and is therefore more expensive to manufacture than the transmitter. Thus to reduce the total cost to manufacture the hide and find game, a transmitter will be incorporated into each of the plurality of game elements to be hidden, and a receiver is incorporated into the portable detector element.

BRIEF DESCRIPTION OF THE DRAWINGS

The invention is illustrated in the figures of the accompanying drawings which are meant to be exemplary and not limiting, in which like parts in the different figures relate to like or corresponding elements, and in which.

DESCRIPTION OF THE PREFERRED EMBODIMENT

Figure 1:
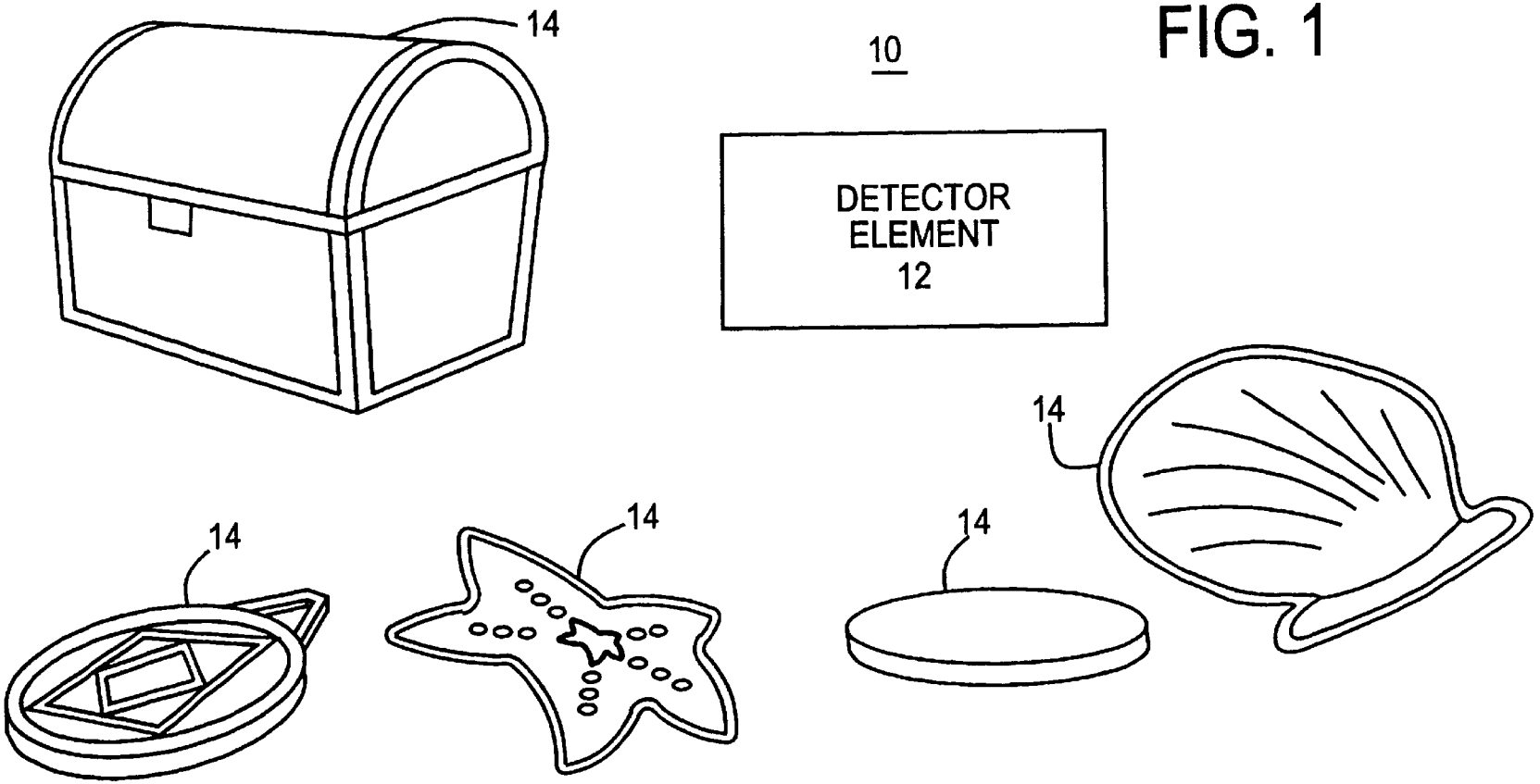
FIG. 1 is a view of the various pieces comprising this game and includes a plurality of game elements to be hidden in a game area and a portable detector element that is carried by the game player throughout the game area to assist in finding the hidden elements.

Referring now to FIG. 1, there is shown a hide and find game 10 in accordance with the teachings of this invention. The game 10 includes a detector element 12 and a plurality of game elements 14 which are employed in accordance with the game 10 to be hidden by a first player in a play area of discrete boundaries. A second player, unaware of where the game elements 14 are hidden, uses the detector element 12 to find the hidden elements 14.

As will be described in detail below, each of the hidden game elements 14 includes a wireless transmitter 16, shown in detail in FIG. 2, to transmit a signal that is used in accordance with the game 10 to locate each of the hidden elements 14. In a particular, illustrative embodiment of this invention, the wireless transmitter 16 transmits a wireless or RF signal of a predetermined frequency. In turn the portable detector element 12 includes a receiver 40, as shown in detail in FIG. 3. The receiver 40 is tuned to receive the signal of predetermined frequency as transmitted by the wireless transmitter 16. In accordance with the intended play of the game 10, when the second player carries the detector element 12 close to any of the first, hidden game elements 14, the receiver 40 in the detector element 12 will give an audio indication that at least one of the hidden elements 14 is spaced not further from the portable detector element 12 than a predetermined distance.

Figure 2:
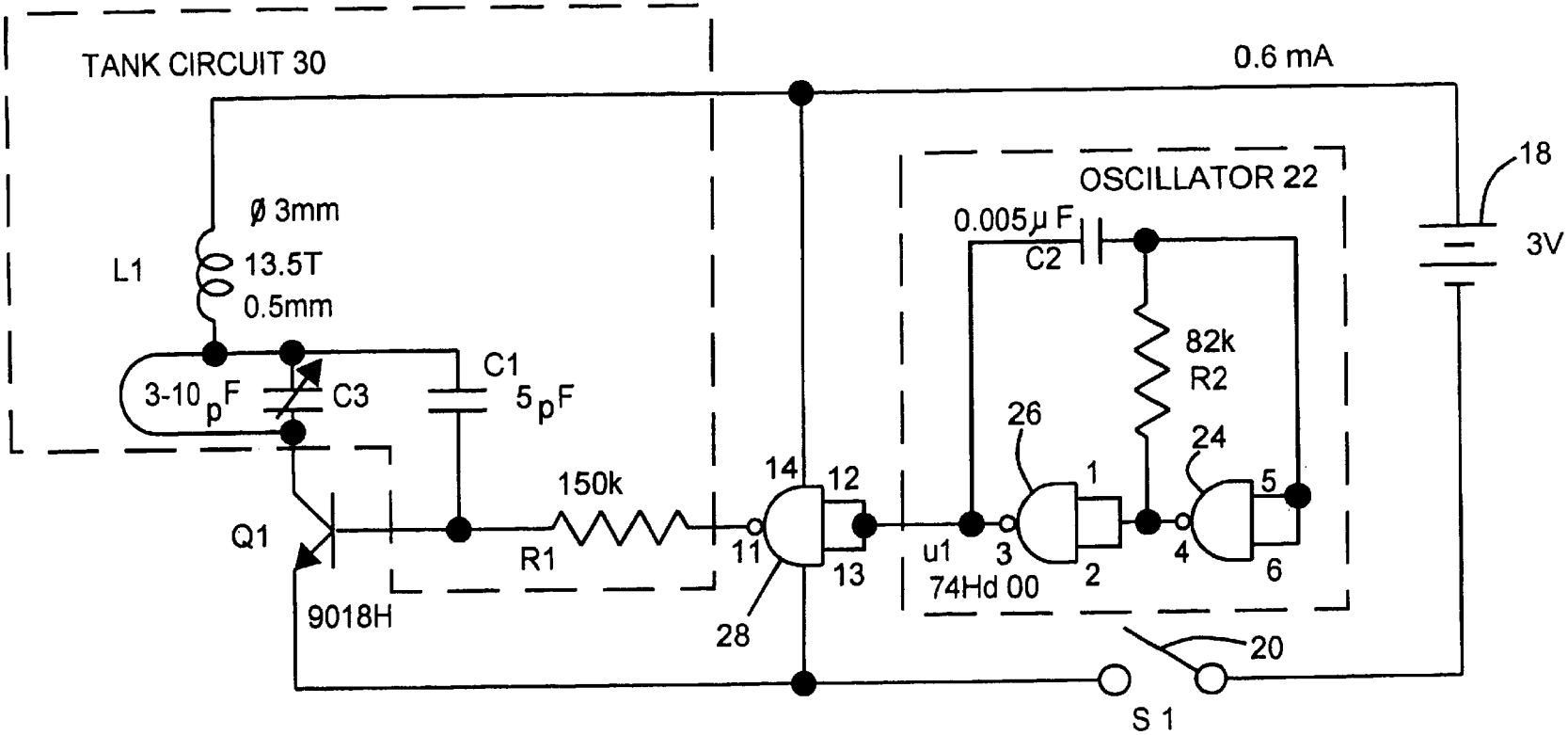
FIG. 2 is a circuit diagram of the various parts which make up a wireless transmitter, which is included in each of the game elements to be hidden in the game area as shown in FIG. 1.

Referring now to FIG. 2, there is shown a preferred embodiment of the wireless transmitter 16, which is incorporated into each of the portable detector elements 12. The transmitter 16 includes a power source 18 in the form of a battery, and a power switch 20, which may be closed by a player when the game is to be played. It is appreciated that in order to extend the life of the power source 18 that the switch 20 should only be closed when the game 10 is to be played and, in particular, the element 14 is to be hidden. The wireless transmitter 16 further includes an oscillator 22, which is comprised of a first gate 24, a second gate 26 and a resistor R2 and a capacitor C2. These elements are configured and of selected impedances to generate at the output terminal 3 of the gate 26 an electrical signal of a desired frequency. In this illustrative embodiment, the frequency is set at a range of 500 Hz to 10 kHz based upon considerations of extending the life of the power source 18 and to facilitate the use in the receiver 40 of elements of reduced cost. In one preferred embodiment of this invention, the output frequency of the oscillator 22 is set at 1 kHz.

In turn, the relatively low frequency generated by the audio oscillator 22 is applied to a buffer gate 28 which isolates the oscillator 22 from the transmitting section of the transmitter 16 to be described. The low frequency signal appearing on the output terminal 11 of the buffer gate 28 is applied to a super-regenerative receiver circuit including a transistor and a tank circuit 30, which is comprised of a variable capacitor C3, an inductor L1, a capacitor C1 and a resistor R1, which are of selected impedances and configured to generate a signal of a frequency, which is relatively high to that generated by the audio oscillator 22. As is understood in the art, the tank circuit 30 generates a carrier signal, which is modulated by the audio signal generated by the oscillator circuit 22. In an illustrative embodiment of this invention, the output signal, which appears across the capacitor C3, has a frequency of 300 MHz. Such a high frequency is illustratively selected in view of the relatively lax regulations set by the Federal Communications Commission. In turn, the high frequency output signal of the tank circuit 30 is applied to the base of a transistor Q1. In turn, the transistor Q1 is switched on and off to apply the voltage that is developed across the variable capacitor C2 to an antenna 32, whereby a high frequency signal is wirelessly transmitted. A further advantage of generating such a relatively high signal is that the dimensions and cost of the antenna 32 may be significantly reduced. In an illustrative embodiment of this invention, the antenna 32 may take the form of an electrically conductive path that is printed on a circuit board. The length of the antenna 32 to generate such a signal may be in the order of ½ inch, which is not deemed to be a critical dimension to permit the wireless transmitter 16 to efficiently operate.

Figure 3:
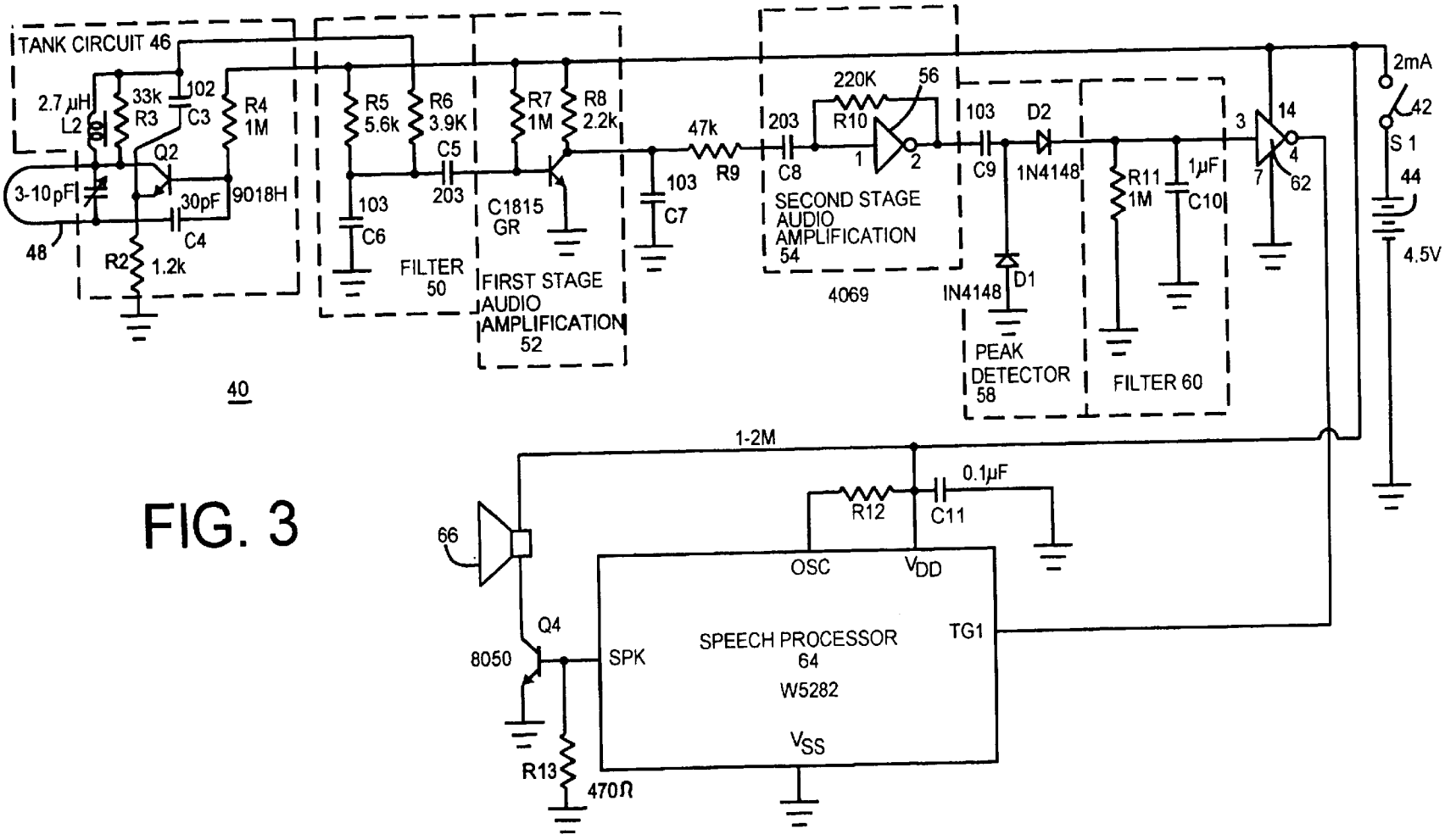
FIG. 3 is a circuit diagram illustrating the parts that make up a receiver, which is included in the detector element shown in FIG. 1.

Referring now to FIG. 3, there is shown a detailed schematic of the various elements and their manner of inner-connection to comprise the receiver 40. In particular, the receiver 40 includes a power supply 44 in the form of a battery and a power switch 42, which may be opened and closed manually by a game player. After the power switch 42 has been closed and the power supply is applied to energize the elements of the receiver 40, the receiver 40 may now operate to receive the signals wirelessly transmitted from one or more of the wireless transmitters 16, which are included in corresponding ones of the hidden elements 14. The wireless or RF signal (or signals) is received by an antenna 48, and is applied thereby to a tank circuit 46, which comprises elements of such impedance and so configured to induce a relatively high signal corresponding to the carrier frequency of the signal transmitted by one or more of the transmitters 16.

In an illustrative embodiment of this invention, the transmitted signal is in the order of 300 MHz frequency. The tank circuit 46 is induced to generate a similar signal that is applied to the base of a transistor Q2 to apply a corresponding signal to a filter 50. The filter 50 is comprised illustratively of a resistor R5, a resistor R6, a capacitor C5, and a capacitor C6, whose impedances and configuration are selected to pass (filter) the audio signal that was imposed upon the high frequency carrier signal by the transmitter 16, while filtering out the relatively high frequency carrier signal. In a preferred embodiment of this invention, the passed audio signal is in the range of 500 Hz to 10 kHz and in a preferred embodiment is 1 kHz. The passed audio signal is in turn applied to a first amplifier 52, which is made up of a resistor R7, a resistor R8 and a transistor Q3. The first amplifier 52, as will become evident from the further description, provides a first stage of audio amplification to the demodulated audio signal. The second stage of audio amplification is provided by a second amplifier 54 which is comprised of a gate 56, a capacitor C8 and a resistor R10 which are configured as shown in FIG. 3. A resistor R9 is inter-connected between the output of the first amplifier 52 and the input of the second amplifier 54 and serves, as will be explained in detail later, to set the gain of the second amplifier 54 and therefore the amplitude of the signal outputted therefrom.

Next, the amplified audio signal is applied to a peak detector 58, which comprises in an illustrative embodiment of this invention a capacitor C9, a Zener diode D1, and a Zener diode D2, which are configured to clip or detect those signals whose amplitudes are in excess of a predetermined amplitude or threshold level. The peak detector 58 operates to detect signals received by the receiver 40 of an amplitude greater than the predetermined threshold level while ignoring or not responding to received RF signals where amplitudes are less than the predetermined level or threshold. It will be appreciated that the further away a particular wireless transmitter 16 is from its hidden element 14 and its receiver 40, the weaker the received signal will be. In other words, the further away a wireless transmitter 16 is from the receiver 40, the smaller the amplitude of the signal received by the receiver 40 and detected by the peak detector 58. Thus, the peak detector 58 is able to distinguish those hidden elements 14 and their wireless transmitter 16 that are spaced from the detector element 12 and its receiver 40 by more than the predetermined distance by not developing a signal at its output and, conversely, identifying those hidden elements 14 and their wireless transmitters 16 that are spaced from the detector element 12 and its receiver 40 by a distance that is less than the predetermined distance.

The signal developed on the output of the peak detector 58 is in turn applied to a filter 60, which converts the AC output of the peak detector 58 to a DC voltage using a capacitor C10 and a resistance R11 configured as shown in FIG. 3. This voltage is in turn applied to a gate 62, which operates to invert the DC voltage, before it is in turn applied to a trigger input TG1 of an audio signal or sound generator 64 in the form of a speech processor, which in one particular embodiment may take the form of a processor manufactured by WINBOND under its designation W5282. In one illustrative embodiment of this invention, the audio signal generator 64 stores first and second messages. Illustratively, the first message would be generated when at least one hidden game element 14 and its wireless transmitter 16 are spaced from the receiver 40 at a distance less than the predetermined distance, indicating that the second player is relatively close to a hidden game element 14. Such a first message, illustratively, may say "We are getting close" or "I see something", thus telling the second player that he or she is relatively close to the hidden game element 14. The second message, illustratively, may say "Let's keep looking" or "I don't see anything", thus indicating to the second player attempting to find a hidden game element 14 that he or she is relatively far away, at least further than the predetermined distance from the hidden game element 14 and therefore, needs to move on hopefully to a position that is relatively close to the hidden game element 14.

As shown in FIG. 3, the SPK output of the audio signal generator 64 is coupled to an audio transducer 66 in the form of a speaker, whereby the stored electrical messages may be converted to audio sounds as may be heard by the players. The transducer 66 may be connected to the SPK output through a transistor Q4 connected to a resistor R13, as shown in FIG. 3, and the transducer 66 is also connected to the switch 42 for received an operating voltage.

The hide and find game 10 of this invention may be operated to carry out the game activity by at least first and second players. Initially, the first player will close the switch 20 of each game element 14 to be hidden that is to be used in the game 10. Then the first player will hide a selected number of the hidden elements 14 throughout the game area. It is appreciated that the game area may be inside or outside of a particular enclosure such as a home or residence. Then the second player, who is unaware of where the elements 14 have been hidden, will pick up the detector element 12 and will energize it by closing its switch 42. As the second player moves through the game space carrying the detector element 12, he or she will in the normal course of the game approach one or more of the hidden elements 14 at a distance less than the predetermined distance. Then, the receiver 40 will detect that a wireless transmitter 16 is relatively close and will operate to actuate the audio signal generator 64 to make a sound that will inform the second player that he or she is relatively close to at least one hidden game element 14. On the other hand, while the second player is spaced a distance from one of the hidden game elements 14 greater than the predetermined distance, the audio signal generator 64 will generate a second different sound which indicates to the second player that he or she is at a distance greater than the predetermined distance from one of the hidden game elements 14. In this fashion, the game elements and, in particular, the detector element 12 and the hidden elements 14 function to guide the second player to find all of the hidden game elements 14.

The game value of this invention is related, at least in one illustrative embodiment, to the setting the threshold level at which the receiver 40 actuates its sound generator 64 as a function of the predetermined distance between the receiver element 12 and the hidden game element or elements 14. Though there is no precise range of the predetermined distance that must be set, the play of the game may be effected if the predetermined distance is set too long or too short. If the threshold level were set too high, i.e., the predetermined distance is too long, the generator 64 would be actuated at any time the receiver element 12 is carried by a player into the game area or, at least, when the detector element 12 is at a distance from one of the hidden game elements 14 that the player would not be particularly helped by actuating the sound generator 64. For example, alerting a player when he or she was far from a hidden game element 14 would not help the player to find that game element 14.

On the other hand if the threshold level were set too low, the sound generator 64 would not be actuated as the player carrying the receiver element 12 through the game area or, at least, may not be actuated in time to prevent the loss of player interest in the game. It is appreciated that this game is intended for use by younger children whose attention spans are short. It has been found that if the predetermined distance is set preferably to be in the range of 5 to 10 feet, the game play is enhanced and the interest of the player is most likely maintained until the hidden game element 14 is found. It is also appreciated that the predetermined distance depends on the size of the play area, the larger the play area the longer the predetermined distance.

It will thus be seen that the objects set forth above, and those made apparent from the foregoing description, are efficiently attained and, since certain changes may be in the forgoing construction without departing from the scope of the invention, it is intended that all matters contained in the foregoing construction or shown in the accompanying drawings shall be interpreted as illustrative and not in a limiting sense. While the invention has been described and illustrated in connection with the preferred embodiment, many variations and modifications, as will be evident to those skilled in the art, may be made without departing from the spirit and scope of the invention.

In the above described preferred embodiment, the predetermined distance is set by adjusting the relative strength of the wireless or RF signal transmitted by the transmitter 40 and the gain imparted to the received signal as imparted by the first and second amplifiers 52 and 54, as well as the particular characteristics of the Zener diodes D1 and D2. The configuration of the particular circuitry or the values of the component parts could be changed, or one or more of these circuits of the receiver 40 could adjusted or a circuit of the transmitter 14 could be changed or adjusted to cause the detector circuit 58 to output a signal that would actuate the sound generator 64. In the illustrated embodiment, the gain of the second amplifier is set by the value of the resistor R9 as shown in FIG. 3. This resistor could be replaced with a resistor of a different resistive value or a variable resistor which could be manually adjusted by the player, without departing from the teachings of this invention. In a further embodiment, the fixed resistor R10 could be changed to a variable resistor to vary the predetermined distance.

The preferred embodiment has been described above in terms of a hard wired circuit of discrete electrical elements, as could be formed on a circuit board. As would be recognized by one skilled in the art, such circuits could be replaced without departing from the scope of this invention by other components such integrated circuit chips or programmed microprocessors, or by combinations of such components.

In the above description, the preferred embodiment incorporates the receiver 40 into the portable detector element 12 and the transmitter 16 into each of the game elements 14 to be hidden. It will be appreciated that the receiver 40 may be incorporated into each of the game elements 14, and the transmitter 16 into the portable element 12, without departing from the scope of this invention. In addition, both of the transmitter 16 and the receiver 40 may be incorporated into one element, i.e., the game element 14 or the portable element 12. In such an embodiment, the other element would require a responding element that would receive the signal transmitted from the transmitter 16 and then retransmit a responsive signal back to the receiver 40 also incorporated into the one element. Such a responsive device could be a passive device and simply reflect energy back to the receiver 40 which would detect the reflected energy. Alternatively, the responsive device could be active and include, for example, a further transmitter and receiver without departing from the teachings of this invention. It is also contemplated that the further receiver could be designed to store and use some of the energy of the signal received from the transmitter 16 to power the responsive device.

In a further contemplated embodiment, the single filter 50 as shown in FIG. 3 could be replaced with a plurality of filters, each of which could be used to demodulate an audio signal of different frequency and to actuate the speech processor 64 to output a different verbal message dependent on the frequency of the received signal. In a similar embodiment, the transmitted signal could be encoded with digital signals, e.g., 001, 011, 101 etc. The receiver 40 would include suitable decoding capability to permit the detection of each coded signal, whereby the speech processor 64 would output a different verbal message.

Though the preferred embodiment shown in FIG. 1 includes a single detector element 12 and a plurality of game elements 14 to be hidden, it is appreciated that a plurality of detector elements 12 could be used to play the game 10 of this invention.

At a minimum, this game 10 could be played with a single detector element 12 and/or a single game element 14 to be hidden.

Figure 4:
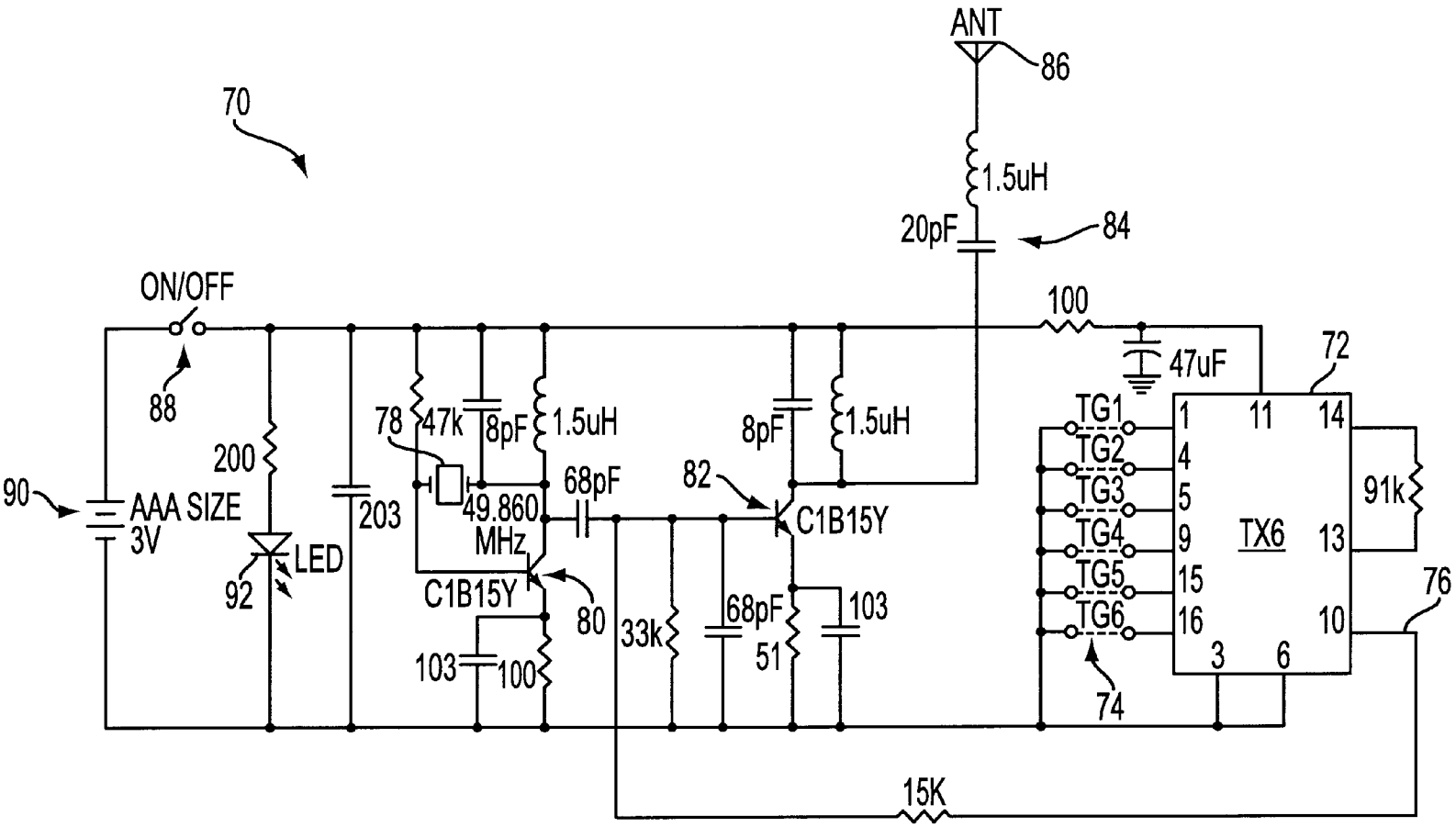
FIG. 4 is a circuit diagram illustrating an alternative embodiment of the transmitter for use in the disclosed game.
Figure 5:
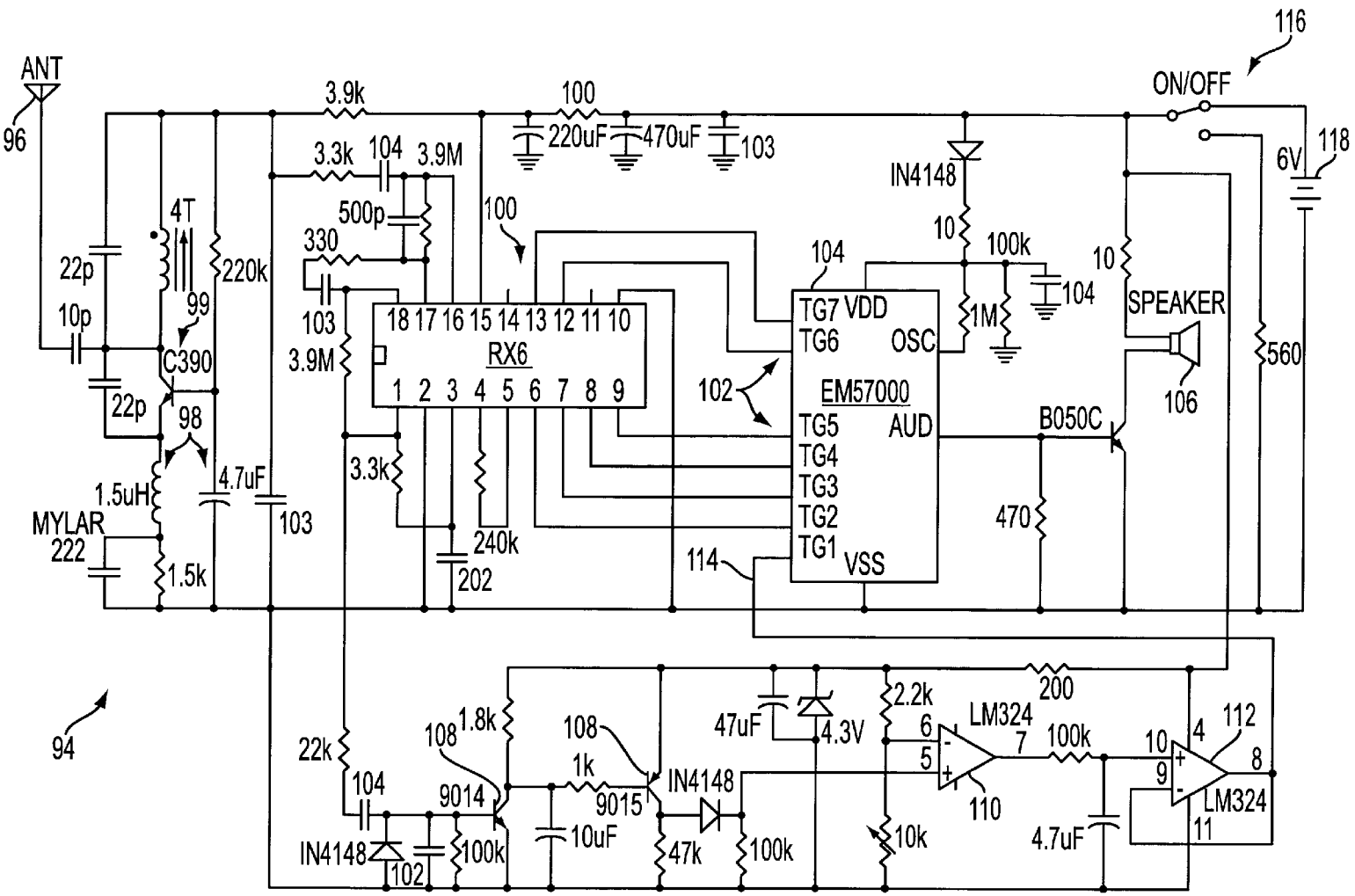
FIG. 5 is a circuit diagram illustrating an alternative embodiment of the receiver for use with the transmitter of FIG. 4 to play the disclosed game.

Referring to FIGS. 4–5, additional embodiments for the transmitter and receiver are respectively illustrated for operating and playing the disclosed hide-and-find game using the components shown in FIG. 1.

The transmitter 70 shown in FIG. 4 includes a transmitter processor 72 which responds to the settings of input lines 74 to generate regular coded pulses on output line 76. For example, the transmitter processor 72 may regularly, at periodic intervals, output predetermined digital pulse of ones and zeros, such as 100111, which forms a coded signature unique to the particular transmitter, and so uniquely identifying the respective hidden game element 14 incorporating the respective transmitter 70. A first hidden game element may output 100111, while a second hidden game element may output 111001.

The transmitter processor 72 may be a TX6 transmitter chip available from Realtek, and the input lines 74 may be hardwired during manufacture of each hidden game element and its respective transmitter circuit 70. Alternatively, the input lines 74 may be incorporated into a dip switch capable of being set to customized values by the user.

The transmitter 70 includes an oscillator 78 generating a 49.860 MHz signal which is applied with the output coded signal on output line 76 to a modulator, which includes a modulating transistor 80. The output coded signal is modulated by the modulating transistor 80 and then amplified by an amplifier, which may include an amplifying transistor 82, to generate an output signal applied to a tank circuit 84 for output by an antenna 86 as an RF or infrared signal representing the coded signature associated with the transmitter 70.

The transmitter 70 may also include an on-off switch for providing operating power to the components thereof from a battery 90. An optional light emitting diode (LED) 92 may also be included to visually indicate to a user that the transmitter 70 is currently transmitting the output coded signal.

In conjunction with the transmitter 70 shown in FIG. 4, a receiver 94 operates to receive and decode the output coded signal and to generate appropriate messages to indicate whether or not the user of the receiver 94 is close or far from a particular transmitter 70 corresponding to the unique code or signature identifying the particular transmitter 70.

In operation, the receiver 94 receives the output coded signal at an antenna 96 and a super-regenerative receiver circuit including a tank circuit 98 and a transistor 99, which pass the received signal to a receiver processor 100, which may be a Realtek RX6 circuit. The receiver processor 100 decodes the received signal to generate a set of pulses on respective input lines 102 to a speech processor 104, which may be a model EM57000 speech processing chip. The receiver processor 100 may optionally amplify the set of pulses to be within a predetermined pulse amplitude for triggering detection upon the input lines 102 by the speech processor 104.

The set of pulses on the input lines 102 identifies the transmitter 70 according to the unique coded signature incorporated in the coded signal received therefrom. From the set of pulses, the speech processor 104 is capable of generating a corresponding audio message for output through a transducer 106, such as an audio speaker, to the user playing the disclosed hide and find game. In one embodiment, the input lines 102 are connected to pins labeled TG2, TG3, TG4, TG5, TG6, and TG7, with a pulse on a specific pin representing a specific transmitter. For example, six game elements 14 with transmitter circuits 70 may be identified with each of the labels TG2, TG3, TG4, TG5, TG6, and TG7, so a pulse on TG2 indicates that a first game element has transmitted its respective signature signal and has been identified, while a pulse on TG7 indicates that a sixth game element has transmitted its respective signature signal and has been identified. The speech processor 104 then outputs voice-like audio messages to the user holding the receiver 94, such as "Item One is near" or "Item Six is detected".

Different codes may also indicate different responses to be carried out by the receiver 94. For example, different codes may trigger different audio responses and/or sound effects.

The receiver 94 also includes a mechanism for detecting whether or not the transmitter 70 and corresponding game element 14 is within a predetermined range, and thence for outputting a first message if the particular game element 14 is near the receiver 94, and for outputting a second message (or no message) if the particular game element 14 is far from the receiver 94.

As shown in FIG. 5, the signal from the transmitter 70 and received at the receiver 94 is applied to the receiver processor 100 and is also applied to a thresholding circuit for determining if the respective transmitter 70 is within or outside of a predetermined range, such as four feet, according to the signal strength of the received signal. The thresholding circuit includes at least one amplifier, such as the transistors 108, which amplify the received signal to then be compared to a reference signal by a comparator 110.

The comparator 110 outputs a detection signal having a first signal level if the transmitter 70 is within the predetermined range, yet outputs the detection signal have a second signal level if the transmitter 70 is outside of the predetermined range. For example, the first signal level may be a high or logic one value, while the second signal level may be a low or logic zero value. The threshold used by the comparator 110 may be set by, for example, the values of resistances at the inputs of the comparator 110. In another embodiment, a variable resistance may be used at one of the inputs of the comparator 110 to allow users to manually adjust the threshold of the detected signal strength, and thence to manually set the range in which a transmitting game element 14 is considered near the receiver 94.

The detection signal from the comparator 110 may be amplified by the amplifier 112, to be applied via input line 114 to an input pin or port of the speech processor 104, such a pin labeled TG1. Depending on the value of the detection signal at TG1, the speech processor 104 outputs different audio messages through the speaker 106.

For example, if a first game element is within the predetermined range, the receiver processor 100 causes a corresponding pulse to be generated and input to pin TG2, while the thresholding circuit causes a signal having the first signal level to be generated and input to pin TG1. In response, the speech processor 104 may generate a first audio message such as "Item One is near".

In another example, a fourth game element may be outside the predetermined range, so the receiver processor 100 causes a corresponding pulse to be generated and input to pin TG5, while the thresholding circuit causes a signal having the second signal level to be generated and input to pin TG1. In response, the speech processor 104 may generate another audio message such as "Item Four is far, keep looking". Similarly, the audio messages may use the traditional phases "hot" and "cold" instead of "near" and "far".

The speech processor 104 may generate an audio message for each signal detected through input lines 102 and pins TG2–TG7. In another embodiment, the speech processor 104 may generate audio messages only for such transmitters 70 for which a signal is detected. For example, if a first game element is transmitting but a second game element is not, a signal is generated and input only to the corresponding input line 102, such as pin TG2, and no signal is input to pin TG3. The speech processor 104 may then only report whether or not the first game element is near or far, but does not provide any report or audio message that the second game element is near or far.

The receiver 94 may include an on-off switch 116 for providing power to the receiver 94 from a power source, such as a battery 118, and for preserving battery life when the receiver 94 is not in use.

It is also to be understood that the following claims are intended to cover all of generic and specific features of the invention herein described, and all statements of the scope of the invention which, as a matter of language, might be said to fall therebetween.

What is claimed is:

1. A hide and find game comprising:

a) a first game element to be hidden in a play area;

b) a second, portable game element to be carried by a player throughout the play area;

c) a wireless transmitter incorporated in one of said first and second game elements to emit a signal of a given strength;

d) a wireless receiver comprising an actuable sound generator and incorporated in said one of said first and second game elements to receive and compare the transmitted signal with a threshold level;

e) a responsive device, included within another of said first and second game elements, for reflecting the transmitted signal from said wireless transmitter incorporated in said one game element, back to said wireless receiver in said one game element;

f) said sound generator actuable to generate a sound informing the player that said second portable game element has been brought closer than a predetermined distance from said first hidden game piece; and g) said threshold level set as a function of said predetermined distance.

2. A hide and find game comprising:

at least one first game element to be hidden in a play area, the at least one first game element including:

a wireless transmitter to emit a signal of a given strength, with the emitted signal encoding a respective one of a plurality of codes;

a second, portable game element to be carried by a player throughout the play area, the second portable game element including:

a wireless receiver having an actuable sound generator to generate a sound informing the player that said second portable game element has been brought closer than a predetermined distance from said first hidden game element, wherein the wireless receiver generates the sound based on a respective code from a respective first game element.

3. The hide and find game of claim 2, wherein the wireless receiver receives and compares the transmitted signal with a threshold level to determine whether or not the second portable game element has been brought closer than the predetermined distance from said first hidden game element.

4. The hide and find game of claim 2, wherein the wireless receiver, responsive to the second portable game element being brought closer than the predetermined distance from said first hidden game element, generates a first message as the sound indicating that such first and second game elements are within the predetermined distance to each other; and wherein the wireless receiver, responsive to the second portable game element being beyond the predetermined distance from said first hidden game element, generates a second message indicating that such first and second game elements are not within the predetermined distance.

5. The hide and find game of claim 2, wherein each of the plurality of codes uniquely identifies each respective first game element.

6. The hide and find game of claim 2, wherein each of the plurality of codes corresponds to a pre-stored message to be emitted as audio to the user.

7. A hide and find game comprising:

a) a first game element to be hidden in a play area;

b) a second, portable game element to be carried by a player throughout the play area;

c) a wireless transmitter incorporated in one of said first and second game elements to emit a signal of a given strength;

d) a wireless receiver comprising an actuable sound generator and incorporated in said one of said first and second game elements to receive and compare the transmitted signal with a threshold level;

e) a responsive device, included within another of said first and second game elements, for receiving the transmitted signal from said wireless transmitter incorporated in said one game element, and, in response to receiving the transmitted signal, sending a signal for reception by said wireless receiver in said one game element;

f) said sound generator actuable to generate a sound informing the player that said second portable game element has been brought closer than a predetermined distance from said first hidden game piece; and g) said threshold level set as a function of said predetermined distance.

8. The hide and find game of claim 7, wherein said responsive device sends said signal for reception by said wireless receiver by reflecting the transmitted signal.

9. The hide and find game of claim 7, wherein said responsive device includes a receiver that receives the transmitted signal, and a transmitter, responsive to said receiver of said responsive device, that sends said signal for reception by said wireless receiver.

* * * * *